US009650183B2

(12) United States Patent
Chen et al.

(10) Patent No.: US 9,650,183 B2
(45) Date of Patent: May 16, 2017

(54) LID ASSEMBLY AND VALVE FOR A LID ASSEMBLY

(71) Applicant: Helen of Troy Limited, Belleville, St. Michael (BB)

(72) Inventors: Tiffany Chang Chen, New York, NY (US); Troy Hunter Phipps, Brooklyn, NY (US); Thomas Chia Hanson, New York, NY (US); Joshua Wiesman, Westen, MA (US)

(73) Assignee: Helen of Troy Limited, Belleville, St. Michael (BB)

( * ) Notice: Subject to any disclaimer, the term of this patent is extended or adjusted under 35 U.S.C. 154(b) by 12 days.

(21) Appl. No.: 14/844,579

(22) Filed: Sep. 3, 2015

(65) Prior Publication Data

US 2017/0066567 A1 Mar. 9, 2017

(51) Int. Cl.
*B65D 47/06* (2006.01)
*B65D 47/20* (2006.01)

(52) U.S. Cl.
CPC ..... *B65D 47/06* (2013.01); *B65D 47/2031* (2013.01)

(58) Field of Classification Search
CPC B65D 47/06; B65D 47/2031; B65D 51/1644; B65D 51/16; B65D 51/1683; B65D 51/24; B65D 41/0435; A47G 19/2272; A47G 19/2266; A61J 11/002; A61J 11/001
USPC ... 220/714, 713, 711, 367.1, 203.18, 203.16, 220/203.15, 203.11, 304, 303, 295, 288, 220/293; 215/314, 311, 307, 228, 310; 222/568, 567, 566, 562, 547, 544
See application file for complete search history.

(56) References Cited

U.S. PATENT DOCUMENTS

| | | | |
|---|---|---|---|
| 5,890,621 | A | 4/1999 | Bachman et al. |
| 6,112,919 | A | 9/2000 | Ho |
| 6,305,570 | B1 | 10/2001 | Atkin et al. |
| 6,422,415 | B1 | 7/2002 | Manganiello |
| 6,508,379 | B1 | 1/2003 | Van De Pol-Klein Nagelvoort et al. |
| 6,616,012 | B2 | 9/2003 | Dark |
| 6,732,882 | B2 | 5/2004 | Belcastro |
| 6,758,364 | B1 | 7/2004 | Rohrig |

(Continued)

FOREIGN PATENT DOCUMENTS

WO 2014/117209 8/2014

OTHER PUBLICATIONS

International Search Report filed in PCT/US2016/047029 mailed Oct. 24, 2016.

*Primary Examiner* — Robert J Hicks
(74) *Attorney, Agent, or Firm* — Rankin, Hill & Clark LLP

(57) ABSTRACT

A lid assembly for a drink container includes a cap, a wall and a valve member. The cap fits onto a drink container and includes a spout defining a drink passage and a vent opening offset from the drink passage. The wall depends downwardly from a lower surface of the cap and surrounds the drink passage and the vent opening. The valve member is selectively receivable within a cavity defined by the wall. With the valve member received in the cavity and the cap fit onto the drink container, a first seal isolates the vent opening from the drink passage, a second seal is movable with respect to the wall and selectively contacts the wall to selectively isolate the vent opening from liquid in the drink container, and a third seal selectively isolates the drink passage from liquid in the drink container.

20 Claims, 4 Drawing Sheets

(56) References Cited

U.S. PATENT DOCUMENTS

| | | | | |
|---|---|---|---|---|
| 6,923,337 | B2 | 8/2005 | Hession et al. | |
| 7,070,065 | B2 | 7/2006 | Wong | |
| 7,575,126 | B2 | 8/2009 | Kemper | |
| 8,333,299 | B2 | 12/2012 | Kemper et al. | |
| 8,403,164 | B2 | 3/2013 | Samson | |
| 2004/0245260 | A1 | 12/2004 | Rohr et al. | |
| 2005/0199637 | A1 | 9/2005 | Wong | |
| 2014/0001192 | A1* | 1/2014 | Steininger | B65D 47/20 220/719 |
| 2016/0213178 | A1* | 7/2016 | Maple | A47G 19/2272 |

* cited by examiner

LID ASSEMBLY AND VALVE FOR A LID ASSEMBLY

BACKGROUND

Drinking cups are frequently used with lids that fit on to the cup to reduce the likelihood for accidental spillage of the contents in the cup. Some of these drinking cups are configured so that if they are turned over, liquid inside the cup is prevented from spilling out of the cup through the use of a valve arrangement in the lid.

One type of drinking cup assembly includes a lid having a spout that a child puts his lips on to drink from the cup. The lid attaches (e.g., snaps or screws on) to the cup over an open top of the cup. A valve is arranged in the lid in or upstream from the spout, and the valve opens to allow liquid to flow out of the cup for drinking. Often the valve is actuated by a vacuum pressure applied by the person sucking on the spout. The vacuum pressure is applied to the interior of the cup and moves or deforms the valve in such a way so that the contents of the cup can flow through a drink passage formed in the spout.

Vacuum pressure actuated drinking cup assemblies of this type have problems associated with balancing the need to provide adequate sealing with the desire to have the valve open easily. A strong seal by the valve can require a relatively large vacuum pressure to open the valve. A seal that requires a lower vacuum pressure to open may not seal tightly enough to prevent leakage. Cleaning of cap, the cup and the valve is also important. Disassembly of the valve from the cap should be easy and intuitive.

SUMMARY

In view of the foregoing, a lid assembly for a drink container includes a cap, a wall and a valve member. The cap is configured to fit onto a drink container and includes a spout defining a drink passage extending through the cap and a vent opening extending through the cap and offset from the drink passage. The wall depends downwardly from a lower surface of the cap and surrounds the drink passage and the vent opening. The valve member is selectively receivable within a cavity defined by the wall and includes a first seal, a second seal and a third seal. With the valve member received in the cavity and the cap fit onto the drink container, the first seal isolates the vent opening from the drink passage, the second seal is movable with respect to the wall and selectively contacts the wall to selectively isolate the vent opening from liquid in the drink container, and the third seal selectively isolates the drink passage from liquid in the drink container.

A valve member for use with a lid assembly configured to connect with a drink container for closing an open top of the drink container includes a cap section, a first seal, an outer wall, and a flap. The cap section includes a fluid passage through which fluid can flow through the cap section. The outer wall extends downwardly from the cap section surrounding the fluid passage. The first seal is provided on the cap section or the outer wall and surrounds the fluid passage. The flap extends outwardly away from the outer wall. The flap has a second seal provided on a distal edge of the flap, and the flap is configured to move with respect to the outer wall when a force is applied on the flap by a vacuum in the drink container.

DETAILED DESCRIPTION

Figure 1:
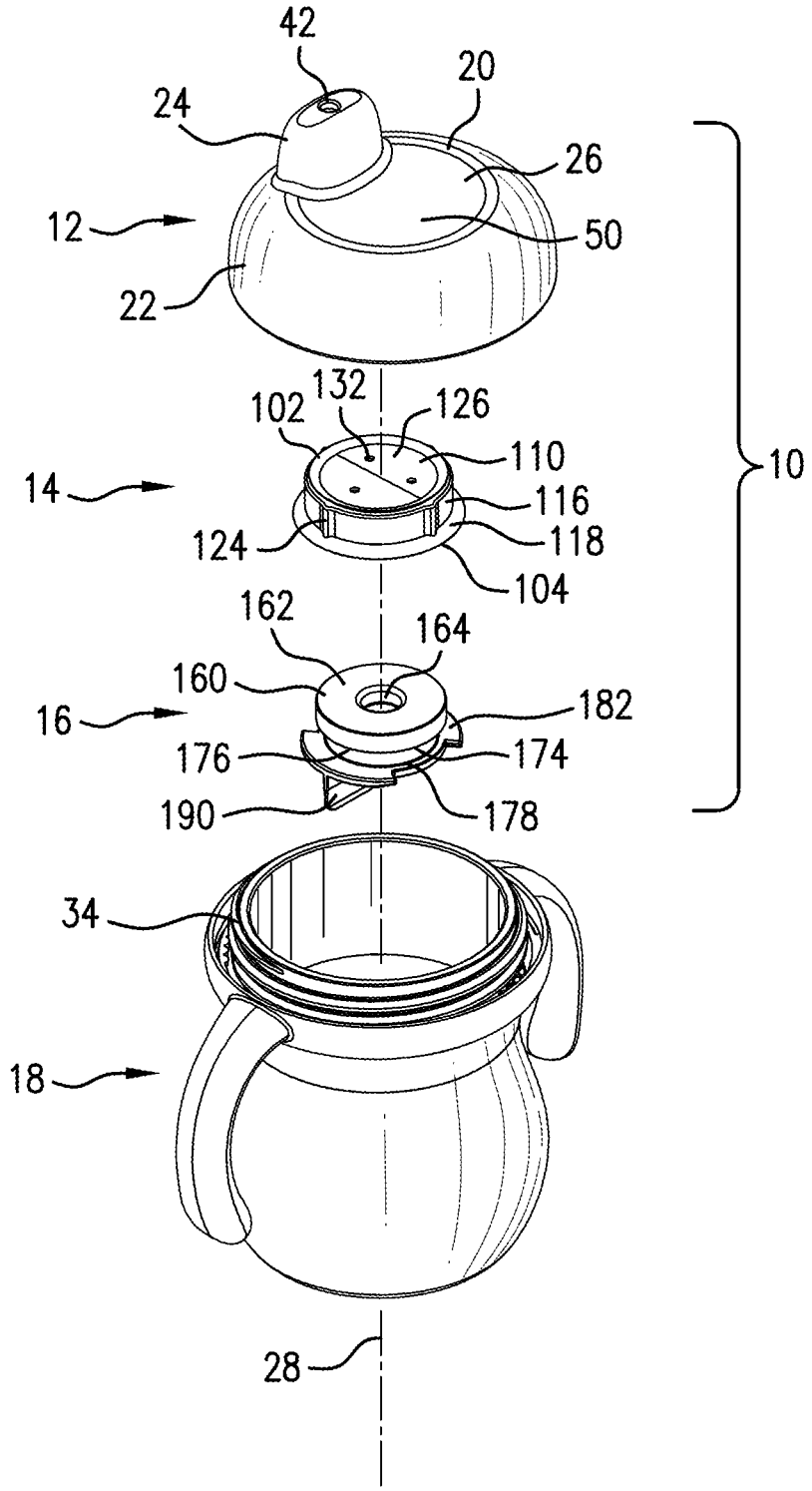
FIG. 1 is an exploded view of a lid assembly and a drink container.
Figure 2:
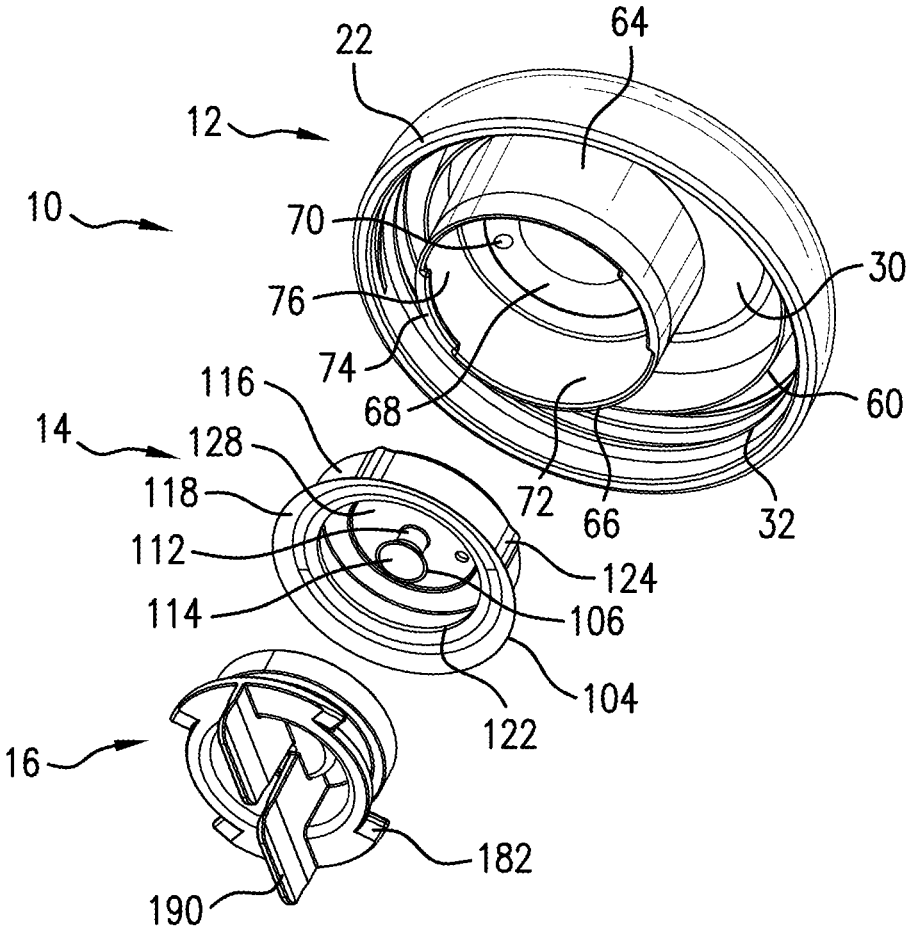
FIG. 2 is an exploded view of the lid assembly of FIG. 1.
Figure 3:
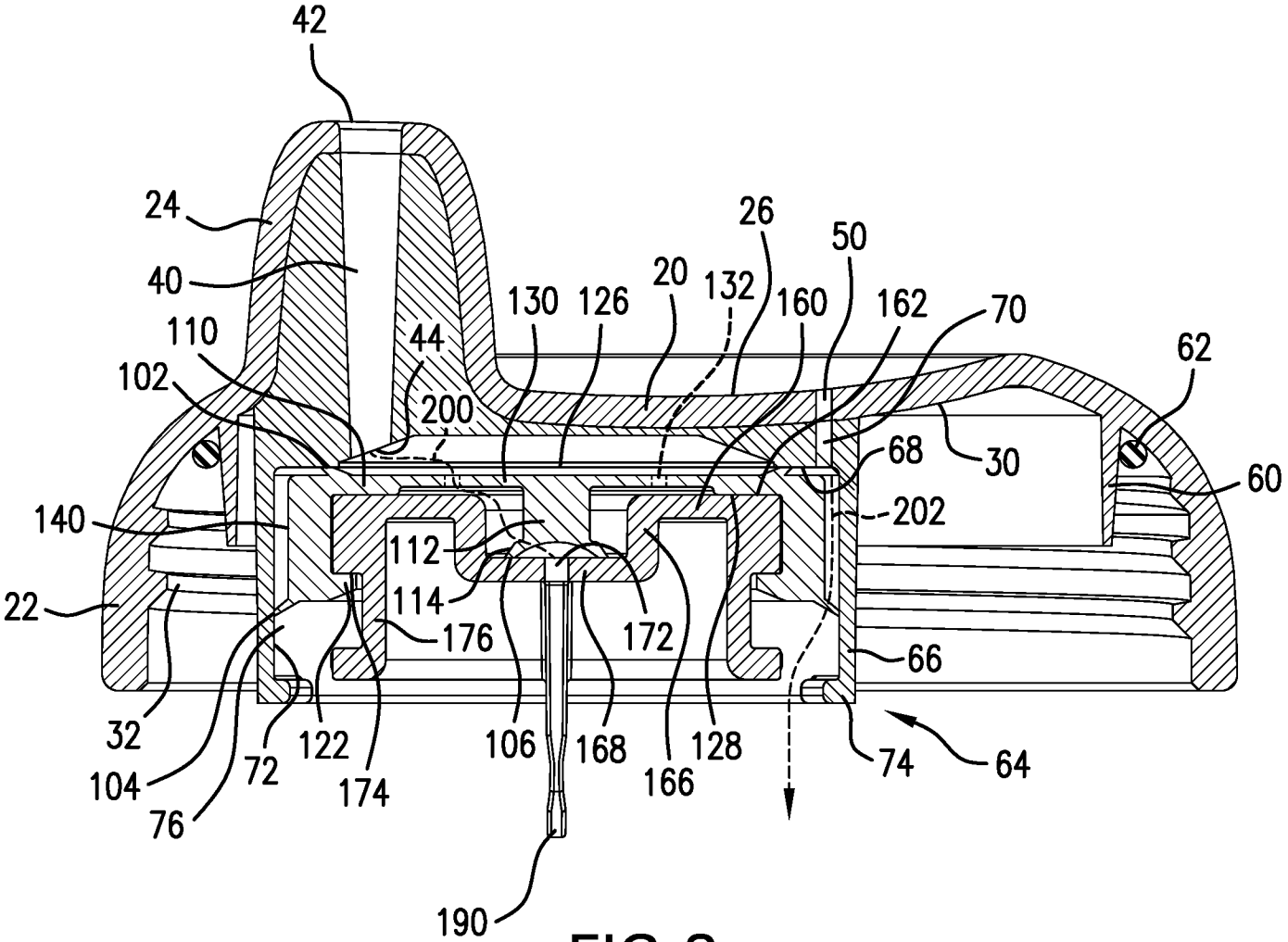
FIG. 3 is a cross-sectional view of the lid assembly of FIG. 1 in an assembled condition ready to be attached to the drink container.

With reference to FIGS. 1-3, a lid assembly 10 includes a cap 12 and a valve member 14. The lid assembly 10 can also include a retainer 16. The cap 12 is configured to fit onto a drink container 18 for closing an open top of the drink container 18. With the valve member 14 and the retainer 16 appropriately connected with the cap 12, the lid assembly 10 prevents liquid in the drink container 18 from spilling out of the drink container when the drink container is tipped over.

In the illustrated embodiment, the cap 12 is made from a rigid plastic material. The cap 12 includes a top wall 20, an outer side wall 22 extending downwardly from the top wall 20, and a spout 24 extending upwardly from the top wall 20. The top wall 20 defines an upper surface 26 of the cap 12. The upper surface 26 faces ambient when the cap 12 is fit onto the drink container. The top wall 20 in the illustrated embodiment is circular in plan view, i.e., normal to a central axis 28. The top wall 20 also includes a lower surface 30 that faces toward the drink container 18 when the cap 12 is fit onto the drink container. The outer side wall 22 is cylindrical in configuration in the illustrated embodiment. Internal threads 32 extend inwardly from the outer side wall 22 for threading onto complementary threads 34 located on the drink container 18 to connect the cap 12 with the drink container 18. The cap 12 could fit onto the drink container 18 in other conventional manners, e.g., a snap or bayonet connection.

The spout 24 defines a drink passage 40 extending through the cap 12. The drink passage 40 terminates at a drink outlet 42, which leads to ambient, and begins at a drink inlet 44 below the drink outlet in FIG. 3. The cap 12 further includes a vent opening 50 extending through the cap 12. The vent opening 50 is offset from the drink passage 40. The vent opening 50 allows air to enter into the drink container 18 while liquid is being removed from the drink container 18 through the drink passage 40.

The cap 12 further includes a lower wall 60 extending downwardly from the lower surface 30. The lower wall 60 is cylindrical in the illustrated embodiment. The lower wall 60 is offset inwardly from the outer side wall 22. A ring-shaped gasket 62 could be received between the lower wall 60 and the outer side wall 22 to provide a seal between the cap 12 and the drink container 18 when the cap 12 is connected with the drink container 18.

The lid assembly 10 also includes a valve mounting structure 64 having a wall 66 that depends downwardly from the lower surface 30 of the cap 12. In the illustrated embodiment, the valve mounting structure 64 is a separate plastic component that is permanently affixed to the cap 12; however, the cap and the valve mounting structure could be formed as one piece. In the illustrated embodiment, the drink passage 40 is provided in the valve mounting structure 64 with the drink inlet 44 provided in a lower mounting structure surface 68 and a vent hole 70 extending through the valve mounting structure 64 and aligned with the vent opening 50. However, the valve mounting structure could be modified so as not to extend into the spout 24, and instead only include the wall 66. In the illustrated embodiment, the wall 66 is cylindrical; however, the valve mounting structure and the wall could take other configurations. The wall 66 of the valve mounting structure 64 surrounds the drink passage 40 and the vent opening 50 (and the vent hole 70). The wall 66 defines an internal surface 72 that also surrounds the drink passage 40 and the vent opening 50. The valve mounting structure 64 also includes flanges 74 (two spaced flanges 74 are shown in the illustrated embodiment) that extend inwardly from a lower end of the wall 66. The flanges 74 cooperate with the retainer 16 to attach the retainer 16 to the cap 12 via the valve mounting structure 64.

The valve member 14 is selectively receivable within a cavity 76 defined by the wall 66 and includes a first seal 102, a second seal 104, and a third seal 106. The valve member 14 in the illustrated embodiment is formed of a resilient material, such as silicone. With the valve member 14 received in the valve mounting structure 64 and the cap 12 fit onto the drink container 18, the first seal 102 isolates the vent opening 50 from the drink passage 40, the second seal 104 selectively isolates the vent opening 50 from the liquid in the drink container, and the third seal 106 selectively isolates the drink passage 40 from the liquid in the drink container 18.

The valve member includes a cap section 110, a stem 112 extending downwardly from the cap section 110, a diaphragm 114 provided at a lower end of the stem 112, an outer wall 116 extending downwardly from the cap section 110, and a flap 118 extending outwardly away from the outer wall 116. The valve member 14 further includes an inward flange 122 extending inwardly from the outer wall 116 for connecting the valve member 14 with the retainer 16. The valve member 14 also includes vertical struts 124 provided on and extending away from the outer wall 116.

In the illustrated embodiment, the cap section 110 is circular in plan view. The cap section 110 defines an upper surface 126 and a lower surface 128, which is opposite the upper surface 126. The cap section 110 includes a thinner central section 130. The lower surface 128 of the cap section 110 at the thinner central section 130 is offset from the retainer 16. The cap section 110 also includes a fluid passage through which fluid can flow through the cap section 110. In the embodiment illustrated in FIGS. 1-3, the fluid passage is made up of three fluid passage openings 132. The fluid passage openings 132 extend through the cap section 110 and thus the valve member 14.

In the illustrated embodiment, the first seal 102 is provided on the cap section 110 and surrounds the fluid passage openings 132. The first seal 102 could be provided elsewhere, for example where the valve mounting structure takes a different configuration, to isolate the vent opening 50 from the drink passage 40. The fluid passage openings 132 are offset inwardly from the first seal 102. The first seal 102 is ring-shaped in the illustrated embodiment and extends upwardly from the cap section 110 of the valve member 14. The first seal 102 contacts the valve mounting structure 64 between the drink passage 40 and the vent opening 50 (and the vent hole 70) when the valve member 14 is received in the cavity 76. In an embodiment where the valve mounting structure 64 does not extend into the spout 24, the first seal 102 could contact the lower surface 30 of the cap 12 between the drink passage 40 and the vent opening 50.

The stem 112 extends downwardly from the cap section 110. In the illustrated embodiment, the stem 112 is cylindrical and is centrally located so as to extend downwardly from the thinner central section 130. The diaphragm 114 is provided at the lower end of the stem 112. The diaphragm 114 in the illustrated embodiment is dome shaped. The diaphragm 114 includes the third seal 106 at its lower end.

The outer wall 116 extends downwardly from the cap section 110 surrounding the stem 112 and the diaphragm 114. The outer wall 116 defines an outer surface 140 of the valve member 14. The outer surface 140 is offset inwardly from the internal surface 72 when the valve member 14 is received in the cavity 76 and the retainer 16 is connected with the valve mounting structure 64. The flap 118 is a circular ring shape in the illustrated embodiment and extends outwardly away from the outer wall 116. The flap 118 includes the second seal 104 at a distal edge of the flap. The second seal 104 selectively contacts the internal surface 72. The flap 118 is provided at a lower end of the outer wall 116 in the illustrated embodiment; however, the flap 118 could be provided elsewhere. The flap 118 is configured to move with respect to the outer wall 116 when a force is applied on the flap 118 by a vacuum in the drink container 18. The vacuum force need not be too high. The amount of suction required to move the diaphragm 114 away from the retainer 16 can result in the force necessary to move the flap 118.

The inward flange 122 extends inwardly from the outer wall 116. The inward flange 122 cooperates with the retainer 16 to attach the valve member 14 to the retainer 16.

The struts 124 are provided to help offset the outer surface 140 of the valve member 14 from the internal surface 72 of the wall 66. The struts 124 can also provide overall rigidity to the valve member 14.

The retainer 16 in the illustrated embodiment is made from a rigid plastic material. The retainer 16 includes a head 160. The head 160 defines a top surface 162 of the retainer. The top surface 162 in the illustrated embodiment is flat and contacts the lower surface 128 of the cap section 110 of the valve member 14 (except for the relatively thinner central section 130) when the lid assembly 10 is assembled. In the illustrated embodiment, the head 160 is circular in plan view so as to connect with the valve member 14. The retainer 16 further includes a recess 164, which in the illustrated embodiment is centrally located on the retainer 16. The recess 164 is formed by a counterbore side wall 166, which is cylindrical in the illustrated embodiment, and a counterbore lower wall 168, which is circular in plan view. The retainer 16 further includes a drink valve opening 172. In the illustrated embodiment, the drink valve opening 172 extends through the counterbore lower wall 168.

The retainer 16 further includes a shoulder 174 where the head 160 transitions to a lower retainer side wall 176. The inward flange 122 on the valve member 14 engages the shoulder 174 on the retainer 16 to connect the valve member 14 with the retainer 16. The retainer 16 further includes a lower flange 178. In the illustrated embodiment, the lower flange 178 is circular in configuration and extends outwardly from the lower retainer side wall 176 at a lower end thereof. Tabs 182 (two spaced tabs 182 are shown in the illustrated embodiment) extend outwardly from the lower flange 178. The tabs 182 cooperate with the flanges 74 of the valve mounting structure 64 to provide a bayonet connection between the retainer 16 and the cap 12. Wings 190 are provided on the retainer 16 to allow an operator to grasp the retainer 16 to facilitate connection of the retainer 16 to the cap 12.

To attach the valve member 14 to the retainer 16, the retainer 16 is inserted into the valve member 14 so that the inward flange 122 on the valve member 14 engages the shoulder 174 on the retainer 16. With the valve member 14 connected with the retainer 16, both the retainer 16 and the valve member 14 are inserted into the cavity 76 with the tabs 182 offset from the flanges 74 so as not to contact the flanges 74 during insertion. The retainer 16 with the valve member 14 attached to it is then rotated so that the tabs 182 ride over the flanges 74 so that the tabs 182 contact the flanges 74.

The cap 12 with the valve member 14 and the retainer 16 is then connected onto the drink container 18. The second seal 104 contacts the internal surface 72 of the valve mounting structure 64 and isolates the vent opening 50 from liquid in the drink container 18 until moved into an open position. The third seal 106 cooperates with the retainer 16 to block flow along a drink valve passage 200 between the drink valve opening 172 and the drink passage 40 until moved into an open position. The third seal 106 selectively contacts the counterbore lower wall 168 on the retainer 16 around the drink valve opening 172 until moved into an open position. To drink from the drink container 18, a person sucks on the spout 24 which results in the diaphragm 114 moving so that the third seal 106 moves away from and no longer contacts the counterbore lower wall 168 on the retainer 16. Liquid is drawn through the drink valve opening 172 in the retainer 16 and along the drink valve passage 200 through the drink passage 40 and out the drink outlet 42. The vacuum that develops in the drink container 18 results in the flap 118 on the valve member 14 moving downwardly (per the orientation shown in FIG. 3) so that the second seal 104 moves away from and no longer contacts the internal surface 72. The valve member 14 includes the outer surface 140 offset from the valve mounting structure 64 when the valve member 14 is received within the cavity 76 so that a vent passage 202 is defined between the outer surface 140 and the internal surface 72. Air enters the drink container 18 via the vent passage 202 when the second seal 104 is not in contact with the internal surface 72. The first seal 102 isolates the vent opening 50 (and the vent passage 202) from the drink passage 40 (and the drink valve passage 200) so that a short circuit is not provided between the vent opening 50 (and the vent hole 70) and the drink passage 40 while drinking.

Figure 4:
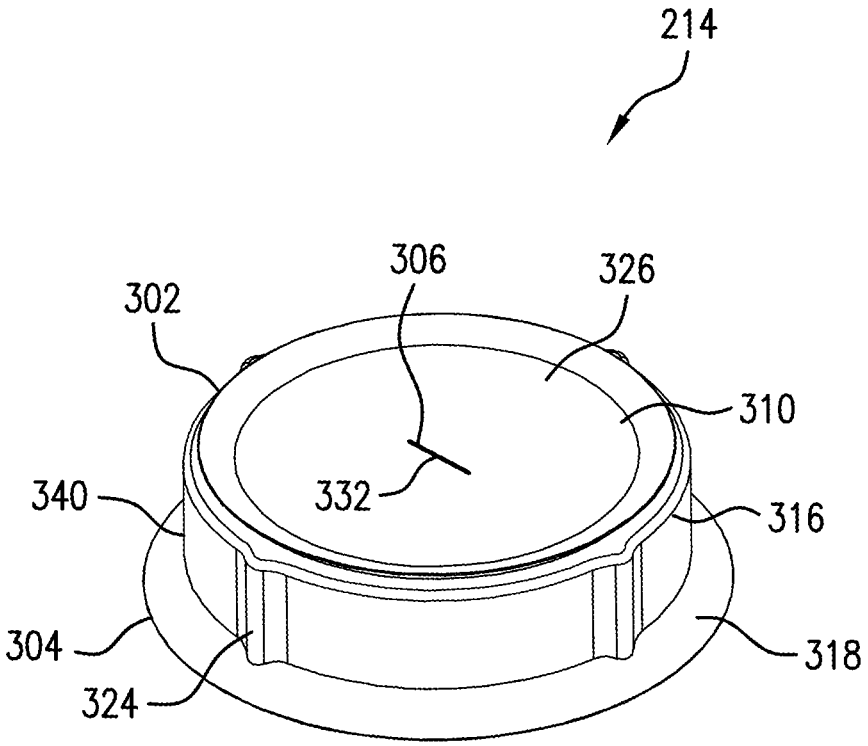
FIG. 4 is a perspective view of an alternative valve member.

FIG. 4 depicts an alternative embodiment of a valve member 214, which is similar to the valve member 14. The valve member 214 is selectively receivable within the cavity 76 and includes a first seal 302, a second seal 304, and a third seal 306. The valve member 214 in FIG. 4 is formed of a resilient material, such as silicone. With the valve member 214 received in the valve mounting structure 64, the first seal 302 isolates the vent opening 50 from the drink passage 40, the second seal 304 selectively isolates the vent opening 50 from the liquid in the drink container when the cap 12 is fit onto the drink container 18, and the third seal 306 selectively isolates the drink passage 40 from the liquid in the drink container 18 when the cap 12 is fit onto the drink container 18.

The valve member includes a cap section 310, an outer wall 316 extending downwardly from the cap section 310, and a flap 318 extending outwardly away from the outer wall 316. The valve member 214 further includes an inward flange (not visible in FIG. 4 but similar in configuration to the inward flange 122) extending inwardly from the outer wall 316 for connecting the valve member 14 with the retainer 16. The valve member 314 also includes vertical struts 324 provided on and extending away from the outer wall 316.

In the embodiment illustrated in FIG. 4, the cap section 310 is circular in plan view. The cap section 310 defines an upper surface 326 and a lower surface (not visible), which is opposite the upper surface 326. The cap section 310 can include a thinner central section, which can part of a membrane making up the cap section 310 (similar to the thinner central section 130). The cap section 310 also includes a fluid passage through which fluid can flow through the cap section 310. In the embodiment illustrated in FIG. 4, the fluid passage is made up a slit 332. The slit 332 extends through the cap section 310 and thus the valve member 214.

The first seal 302 is provided on the cap section 310 and surrounds the slit 332. The slit 332 is offset inwardly from the first seal 302. The first seal 302 is ring-shaped in the illustrated embodiment and extends upwardly from the cap section 310 of the valve member 214. The first seal 302 contacts the valve mounting structure 64 or the lower surface 30 of the cap 12 between the drink passage 40 and the vent opening 50 when the valve member 14 is received in the valve mounting structure 64. The first seal 302 could also be provided on the outer wall 316 to isolate the drink passage 40 from the vent opening 50. For example, a shorter cylindrical wall (not shown) could be positioned inside the wall 66 shown in FIGS. 2 and 3. The shorter cylindrical wall would surround the drink passage 40, but not the vent opening 50. In this example, the first seal 302 could be on the outer wall 316 and contact the inner surface of the shorter cylindrical wall to isolate the drink passage 40 from the vent opening 50. The second seal 304 would still selectively contact the wall 66.

The valve member 214 does not include a stem (similar to the stem 112) or the diaphragm (similar to the diaphragm 114) like the valve member 14 described above. Instead, the third seal 106 is formed by the slit 332 and the membrane on the cap section 310 selectively opening and closing to allow fluid to pass through the slit 332 en route to the drink passage 40. If desired the cap section 310 (or a portion of the membrane making up the cap section 310 around the slit 332) can be dished inwardly to aid in sealing the slit 332.

The outer wall 316 extends downwardly from the cap section 310 surrounding the slit 332. The outer wall 316 defines an outer surface 340 of the valve member 214. The outer surface 340 is offset inwardly from the internal surface 72 of the wall 66 when the valve member 14 is received in the cavity 76 and the retainer 16 is connected with the valve mounting structure 64. The flap 318 is a circular ring shape in the illustrated embodiment and extends outwardly away from the outer wall 316. The flap 318 includes the second seal 304 at a distal edge of the flap. The second seal 304 selectively contacts the internal surface 72. The flap 318 is provided at a lower end of the outer wall 316 in the illustrated embodiment; however, the flap 318 could be provided elsewhere. The flap 318 is configured to move with respect to the outer wall 316 when a force is applied on the flap 318 by a vacuum in the drink container 18. The vacuum force need not be too high. The amount of suction required to open the slit 332 can result in the force necessary to move the flap 318.

The valve member 214 would operate similar to the valve member 14 described above with the sealing of the first seal 302 and the second seal 304 being similar to the first seal 102 and the second seal 104. The valve member 214 connects with the retainer 16 in a manner similar to the valve member 14. The valve member 214 differs from the valve member 14 in that the slit 332 opens when a person sucks on the spout 24. Fluid would pass through the slit 332 en route to the drink passage 40 passing first through the drink valve opening 172. When suction is removed, the slit 332, which would operate as the third seal 306, would reseal.

A lid assembly and valve members for such an assembly have been described above with particularity. Modifications and alterations will occur to those upon reading and understanding the preceding detailed description. The invention, however, is not limited to only the embodiments described above. Instead, the invention is broadly defined by the appended claims and the equivalents thereof. It will also be appreciated that various of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A lid assembly for a drink container comprising:

a cap configured to fit onto a drink container, the cap including a spout defining a drink passage extending through the cap and a vent opening extending through the cap and offset from the drink passage;

a wall depending downwardly from a lower surface of the cap and surrounding the drink passage and the vent opening;

a valve member selectively receivable within a cavity defined by the wall and including a first seal, a second seal and a third seal, with the valve member received in the cavity and the cap fit onto the drink container, the first seal isolates the vent opening from the drink passage, the second seal is movable with respect to the wall and selectively contacts the wall to selectively isolate the vent opening from liquid in the drink container, and the third seal selectively isolates the drink passage from liquid in the drink container; and a retainer selectively connectable with the wall and configured to connect with the wall to retain the valve member in the cavity, wherein the retainer includes a drink valve opening and the third seal cooperates with the retainer to selectively block flow along a drink valve passage between the drink valve opening and the drink passage, wherein the valve member includes a fluid passage opening offset inwardly from and surrounded by the first seal, wherein the fluid passage opening is located along the drink valve passage.

2. The assembly of claim 1, wherein the valve member includes a diaphragm having the third seal at a lower end of the diaphragm.

3. The assembly of claim 2, wherein the valve member includes a cap section and a stem extending downwardly from the cap section, wherein the fluid passage opening extends through the cap section and the diaphragm is provided at a lower end of the stem.

4. The assembly of claim 1, wherein the valve member includes an outer surface offset from the wall when the valve member is received within the cavity, wherein a vent passage is defined between the outer surface and the wall extending from the vent opening to the second seal.

5. The assembly of claim 4, wherein the valve member includes a flap extending outwardly away from the outer surface, wherein the flap includes the second seal at a distal edge.

6. The assembly of claim 1, wherein the wall is cylindrical.

7. A lid assembly for a drink container comprising:

a cap configured to fit onto a drink container, the cap including a spout defining a drink passage extending through the cap and a vent opening extending through the cap and offset from the drink passage;

a wall depending downwardly from a lower surface of the cap and surrounding the drink passage and the vent opening; and a valve member selectively receivable within a cavity defined by the wall and including a first seal, a second seal and a third seal, with the valve member received in the cavity and the cap fit onto the drink container, the first seal isolates the vent opening from the drink passage, the second seal is movable with respect to the wall and selectively contacts the wall to selectively isolate the vent opening from liquid in the drink container, and the third seal selectively isolates the drink passage from liquid in the drink container, wherein the valve member includes a cap section having a fluid passage opening offset inwardly from and surrounded by the first seal, a stem extending downwardly from the cap section, a diaphragm provided at a lower end of the stem, an outer wall extending downwardly from the cap section surrounding the stem and the diaphragm and a flap extending outwardly away from the outer wall.

8. The assembly of claim 7, wherein the first seal is provided on the cap section between the outer wall and the fluid passage opening.

9. The assembly of claim 8, wherein the second seal is provided on a distal edge of the flap.

10. The assembly of claim 9, wherein the third seal is provided at a lower end of the diaphragm.

11. The assembly of claim 8, wherein the first seal is ring-shaped and extends upwardly from the cap section.

12. The assembly of claim 7, wherein the flap is a circular ring shape.

13. The assembly of claim 7, further comprising a retainer selectively connectable with the wall and configured to connect with the wall to retain the valve member in the cavity, wherein the valve member includes an inward flange extending inwardly from a lower end of the outer wall, wherein the inward flange cooperates with the retainer to attach the valve member to the retainer.

14. The assembly of claim 7, wherein the valve member includes struts provided on and extending away from the outer wall.

15. A lid assembly for a drink container comprising:

a cap configured to fit onto a drink container, the cap including a spout defining a drink passage extending through the cap and a vent opening extending through the cap and offset from the drink passage;

a wall depending downwardly from a lower surface of the cap and surrounding the drink passage and the vent opening; and a valve member selectively receivable within a cavity defined by the wall and including a membrane, a first seal, a second seal and a slit provided in the membrane, with the valve member received in the cavity and the cap fit onto the drink container, the first seal isolates the vent opening from the drink passage, the second seal is movable with respect to the wall and selectively contacts the wall to selectively isolate the vent opening from liquid in the drink container, and selective opening and closing of the slit selectively isolates the drink passage from liquid in the drink container.

16. The assembly of claim 15, wherein the valve member includes a cap section, an outer wall extending downwardly from the cap section surrounding the slit and a flap extending outwardly away from the outer wall, wherein the first seal is provided on the cap section between the outer wall and the slit, wherein the second seal is provided on a distal edge of the flap.

17. The assembly of claim 15, wherein the first seal is ring-shaped and extends upwardly from the cap section.

18. The assembly of claim 15, wherein the flap is a circular ring shape.

19. The assembly of claim 15, further comprising a retainer selectively connectable with the wall and configured to connect with the wall to retain the valve member in the cavity, wherein the valve member includes an inward flange extending inwardly from a lower end of the outer wall, wherein the inward flange cooperates with the retainer to attach the valve member to the retainer.

20. The assembly of claim 15, wherein the valve member includes struts provided on and extending away from the outer wall.

* * * * *